United States Patent [19]

Altmayer

[11] 4,117,493

[45] Sep. 26, 1978

[54] RADIO ANTENNA

[75] Inventor: John Altmayer, Cape Coral, Fla.

[73] Assignee: New-Tronics Corp., Brookpark, Ohio

[21] Appl. No.: 753,318

[22] Filed: Dec. 22, 1976

[51] Int. Cl.[2] ..... H01Q 1/32; H01Q 9/00; H01Q 1/00; H01Q 1/08

[52] U.S. Cl. ..... 343/750; 343/715; 343/880; 343/720

[58] Field of Search ..... 343/715, 720, 749, 750, 343/792, 880

[56] References Cited

U.S. PATENT DOCUMENTS

| | | | |
|---|---|---|---|
| 2,480,172 | 8/1949 | Willoughby | 343/872 |
| 3,400,403 | 9/1968 | Spilsbury | 343/750 |
| 3,576,578 | 4/1971 | Harper | 343/792 |
| 3,961,332 | 6/1976 | Middlemark | 343/792 |

OTHER PUBLICATIONS

Harry Lowenstein, *Designing & Building a Five Band Indoor Antenna,* In CQ, pp. 46–47, Dec. 1967.

*Primary Examiner*—Alfred E. Smith

*Assistant Examiner*—Harry E. Barlow

*Attorney, Agent, or Firm*—Meyer, Tilberry & Body

[57] ABSTRACT

A radio antenna which can be readily tuned to the exact frequency of operation, easily coupled to a coaxial feed-line with minimum standing wave ratio and/or which is normally vertical and can be used where horizontal space is at a premium, such as: indoors or on boats. The antenna has a center loading coil, the inductance of which is adjusted by means of a split coaxial sleeve axially moveable relative to the coil. The input impedance of the antenna is adjusted relative to the impedance of the feed-line by means of a coupling transformer, the transformation ratio of which is controlled by means of a coaxial split metal sleeve axially adjustable relative thereto. A coaxial cable wound into a coil around a ferrite core attenuates the high ratio frequency voltage on the end of the antenna to the feed-line. For indoor use, the antenna is housed in an extensible tubular housing which can be extended to engage the ceiling and floor of a room to hold the antenna in vertical position.

30 Claims, 4 Drawing Figures

RADIO ANTENNA

This invention relates to the art of radio antennas for transmitters and/or receivers and more particularly to a radio antenna having improved means for being tuned to resonance with the output frequency of a transmitter, for matching its input impedance to the output impedance of a transmitter, and/or for holding itself vertical in a room when used indoors.

The invention is particularly applicable to a vertical antenna to be used indoors in conjunction with Citizens' Band transmitters and/or receivers and will be described with particular reference thereto although it will be appreciated that the antenna may be used on other frequencies and in some respects, some of the features may be used out-of-doors and on antennas for other uses, e.g. marine, automotive, aircraft, and/or amateur.

While the invention is usable with either transmitters and/or receivers, reference hereinafter will only be made to transmitters, as here, its novel features become important.

Vertical antennas heretofore have taken the form of a vertical quarter wave linear element working against a counter-balance system which may be either the ground itself or a plurality of radials which extend out either horizontally from the axis of the antenna or downwardly and outwardly in the form of drooping radials.

Such antennas are normally energized from a coaxial cable feed-line with the center conductor of the cable connecting to the base of the vertical antenna and the shield connecting to the radial elements or the ground.

Such an antenna requires so much horizontal and/or vertical space as to be impossible to use indoors. While it has been possible to shorten the antenna by means of loading coils either at its base or intermediate its ends, the use of such a loading coil makes tuning of the antenna to the exact frequency of the transmitter quite difficult and usually quite critical. No way has been found to eliminate the need for horizontal space.

Other vertical antennas have taken the form of a half wave linear element feed at the lower end from a feed-line through a matching stub or a tuned coil. Such feed or matching systems are bulky, difficult and critical to adjust and are generally undesirable. Of course, these antennas may have their overall length shortened by the use of loading coils intermediate the ends so that the antenna has an effective electrical length longer than its actual physical length.

With the great increase in the use of Citizens' Band transmitters, there is need for a transmitting antenna which can be used indoors, which is unobtrusive in appearance and takes up a minimum of horizontal space within a room. The same is also true in marine, mobile, or amateur work. Further, there is need for transmitting antennas which can be easily tuned to a desired transmitting frequency and which can be easily and quickly matched to the output impedance of a transmitter.

The present invention contemplates a new and improved radio antenna which overcomes all of the above referred to difficulties and others and provides an antenna which has a relatively high transmitting efficiency, which is relatively easy to adjust, which occupies a minimum area in a room or elsewhere, and is attractive in appearance.

In accordance with the invention, a vertical radio antenna intended for indoor use is provided, comprised of an elongated electrically conductive member of a vertical length less than the height of the room in which it is to be used in combination with an electrically insulating member extending beyond an end of the conductive member and extendable relative thereto whereby the remote ends of the members may be made to engage the ceiling and floor of the room to support the conductive member in a vertical position.

Further in accordance with the invention, the antenna is housed in a pair of axially slidable tubes of electrically insulating material which can be extended so as to engage the ceiling and floor of the room.

Also, in accordance with the invention, a radio antenna is provided comprised of an elongated conductive member having a loading coil intermediate its ends in combination with a coaxial split metal sleeve which can be adjusted axially relative to the loading coil to adjust the resonant frequency of the antenna over a band of frequencies.

This sleeve is preferably positioned on the side of the loading coil towards the free end of the antenna so that in effect also serves as a "top hat" for the antenna.

Also in accordance with the invention, an end fed vertical antenna is provided comprised of an elongated electrically conductive member having a multi-turn coil at one end coupled to one end of a coaxial cable formed into a multi-turn coil about a ferrite core, the other end of the coaxial cable being adapted to be connected to a transmitter, in combination with a split metallic sleeve coaxial with the coil and axially adjustable relatively thereto for adjusting the impedance transformation between the feed end of the antenna and the coaxial cable feed-line from the transmitter.

By extending the housing, the antenna may be removably held at a vertical position within the room. By adjusting the sleeve relative to the loading coil, the antenna may be tuned to an exact frequency of operation but maybe operated over a range of frequencies on each side thereof. By adjusting the sleeve relative to the coil on the free-end of the antenna, the reflected power due to impedance matching, may be reduced to zero, that is to say a standing wave ratio of 1.0 to 1 is easily obtained.

The principal object of the invention is the provision of a new and improved vertical antenna which can be used indoors and has a maximum radiating efficiency.

Another object of the invention is the provision of a new and improved vertical antenna which can be used indoors and which will occupy a maximum of less than one and one quarter square inches of floor space.

Another object of the invention is the provision of a new and improved vertical antenna for use indoors wherein the antenna is housed in an axially extendable insulating housing which housing can be extended to engage the floor and the ceiling of a room to support the antenna in a vertical position.

Another object of the invention is the provision of a new and improved arrangement for tuning a vertical center-loaded antenna to a desired frequency of operation.

Another object of the invention is the provision of a new and improved center loaded vertical antenna which may be readily tuned to an exact resonant frequency within a band of frequencies.

Another object of the invention is the provision of a new and improved arrangement for end feeding of a vertical antenna from a coaxial cable wherein the standing wave ratio on the feed-line can be adjusted to approximately 1.0 to 1.

Another object of the invention is the provision of a new and improved end fed vertical antenna where the electrical length may be chosen for a desired angle of radiation and the impedance of the feed-end of the antenna may be readily matched to the impedance of a standard coaxial cable so as to have a minimum SWR.

Another object of the invention is the provision of a new and improved vertical antenna which can be used indoors and which can be made relatively attractive in appearance and relatively unobtrusive to others in the room.

The invention may take physical form in certain parts and arrangements of parts, a preferred embodiment of which will be described in detail and illustrated in this specification and the accompanying drawings which form a part hereon and wherein.

Figure 1:
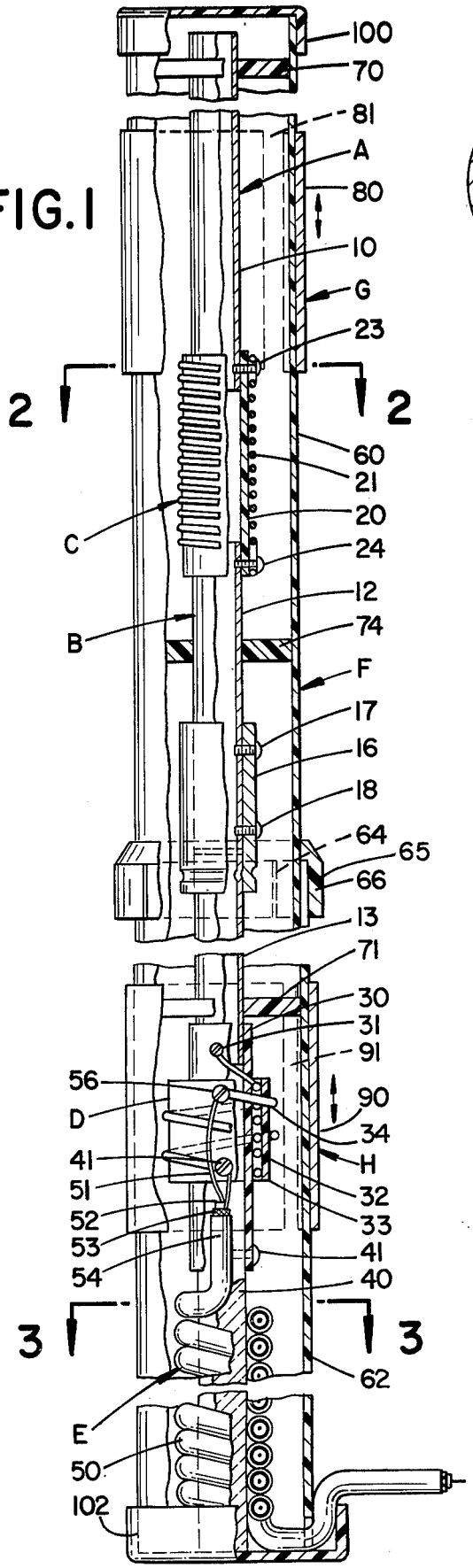
FIG. 1 is a side elevational view partly in cross section showing a preferred embodiment of the invention.
Figure 2:
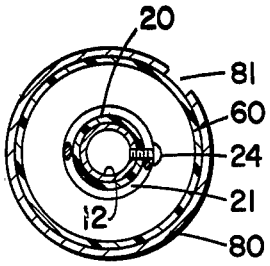
FIG. 2 is a cross-sectional view of FIG. 1 taken approximately in the line 22 thereof.
Figure 3:
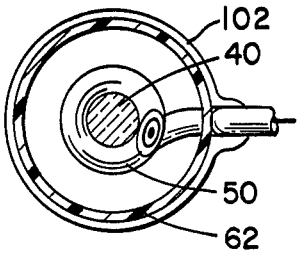
FIG. 3 is a cross-sectional view of FIG. 1 taken approximately in the line 33 thereof; and, FIG. 4 is a schematic view of the electrical circuit of the antenna, the adjustable split sleeves being shown in phantom lines relative to the coils of the inductances of which they adjust.
Figure 4:
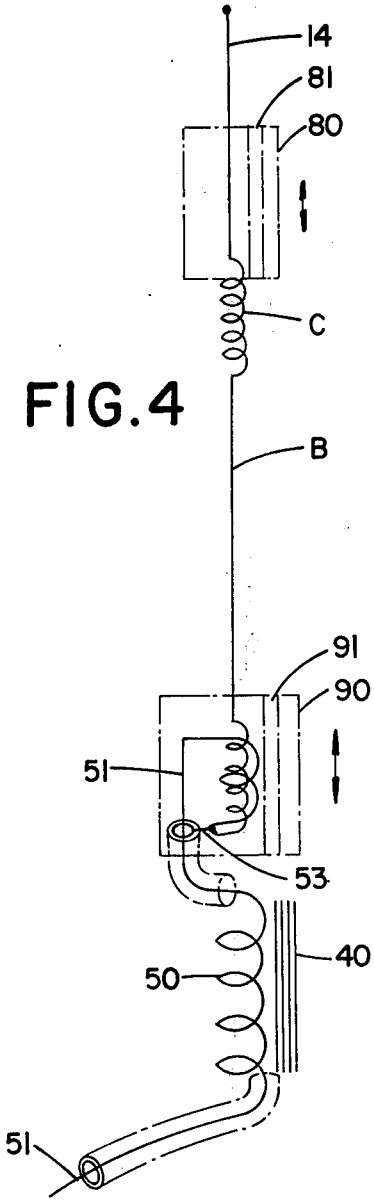

Referring now to the drawings, wherein the showings are for the purposes of illustrating a preferred embodiment of the invention only and not for limiting same, FIG. 1 shows an antenna comprised of: an upper radiating portion A, a lower radiating portion B, an intermediate loading coil C between the upper and lower radiating portions A and B, a coupling transformer D at the lower end of the radiating portion B, an isolator inductance E, an extendable housing F surrounding the above, a tuning member G for the loading coil C and a impedance transformation adjusting member H for the transformer D.

The radiating portions of the antenna A, B, and C are relatively conventional and need not be described in great detail. Suffice it to say that the upper radiating portion A is in the form of a thin-walled tube 10 of electrically conductive material such as aluminum and for an antenna operable in the 27.0 megahertz citizens' band has a length of approximately 20.75 inches.

The lower radiating portion B is likewise formed of thin walled aluminum tubing but in two portions 12, 13 in axial alignment and held in such alignment and in electrically conductive relationship by means of a sleeve 16 which is crimped about the upper end of the tube 13 and removably receives the lower end of the tube 12, which tube 12 is then held in position by means of locking screws 17, 18. The total length of the tubes 12, 13 is 54.0 inches.

The loading coil C is in the form of a phenolic tube 20 (¾ inches O.D.) which telescopes over the upper end of the tube 12 and the lower end of the tube 10 and a multi-turn (28 turns # 22 wire) coil 21 wound on the outside of the tube 20. The upper end of this coil 21 is connected to a screw 23 which extends through the wall of the phenolic tube 20 into the wall of the tube 10 to connect the upper end of the coil 21 to the tube 10. In a like manner, the lower end of the coil 21 is connected to a screw 24 which extends through the wall of the phenolic tube 20 into engagement with the upper end of the tube 12 to connect the lower end of the coil 21 to the upper end of the tube 12. In this way, there are two aligned lineal radiating portions with a loading coil 21 in electrical series therewith. The effect is to increase the effective electrical length of the antenna substantially beyond its physical length.

The lower end of the tube 12 is telescoped into the upper end of a phenolic tube (¾ inch O.D.) 30 and is fastened thereto by means of a screw 31 which extends diametrically throught the lower end of the tube 13 and the upper end of the phenolic tube 30.

The coupling transformer D is wound on the phenolic tube 30 and is comprised of a multi-turn (17 turns #22 wire) coil 32 having its upper end electrically connected to the screw 31 and thus to the lower end of the tube 13. A layer of insulation 33 surrounds the coil 32 and a coupling coil 34 (2 turns #17 wire) is wound around the insulation and is thus in inductive relationship with the coil 32. The turns of this coil are spaced so that the axial length is coextensive with coil 32.

The lower end of the phenolic tube 30 telescopes over the upper end of a ferrite rod 40 and is fastened thereto by means of a screw 41. The ferrite rod 40 as shown extends to the lower end of the antenna.

The isolation inductance E is comprised of a plurality of turns (30 turns RG58) 50 of coaxial cable wound around the ferrite core 40. The coaxial cable, as is conventional, is comprised of a center conductor 51, a coaxial insulating sleeve 52, a braided sleeve 53 and an outer insulating sleeve 54. In the embodiment of the invention shown, the inner conductor 51 of the coaxial cable extending from the top of the coil 50 connects to the upper terminal 56 of the coupling coil 34 while the shield 53 connects to screw 41 to which the lower terminal of the coil 34 also connects. The high inductance of the coiled shield isolates high radio frequency voltage on the lower end of the radiating portion B from the lower end of the coil 50 and thus from the feed-line to the transmitter.

In summary, the upper terminal of the coil 32 connects to the lower end of the linear element B and the lower terminal of the coil 32 connects to the shield 53 of the coaxial cable as well as the lower terminal of the coil 34 with the inner conductor 51 of the coaxial cable connecting to the upper terminal 56 of the coupling coil. Electrical energy fed through the coaxial cable is inductively coupled to the lower end of the antenna.

The coaxial cable at the lower end of the coil 50 is adapted to be connected to a transmitter and/or receiver (not shown) through a length of coaxial cable (not shown).

The entire antenna just described is enclosed in the housing F. In accordance with the invention, the housing F is comprised of an upper tube 60 of electrically insulating and preferably plastic material, the lower end of which telescopes into the upper end of a plastic tube 62. The two tubes 60, 62 are thus telescoped one into the other and are axially adjustably relative to each other. The upper end of the tube 62 has a plurality of short vertically extending slots 64 forming radially flexible fingers 65. A plastic cap 66 fits over the fingers 65 and when pressed downwardly, forces the flexible fingers 65 into airtight frictional engagement with tube 60 locking the two tubes 60, 62 in any adjusted axial position. The housing thus forms a member of electrically insulating material which can be extended beyond the end of the upper radiating portion A.

A plurality of insulating spacers 70, 71, 74 are positioned at spaced intervals between the various parts of the antenna and the housing H so as to maintain the antenna centrally located within the housing. Any number of spacers may be employed.

As an important part of the present invention, means are provided for varying the inductance of the loading coil C. Such means in the preferred embodiment comprise a sleeve 80 of electrically conductive material, e.g. copper or aluminum, slidably mounted on the outside of the tube 60. This sleeve has a longitudinally extending slot 81 throughout its axial length such that the sleeve 80 may be referred to as a split sleeve. Its normal internal diameter is just less than the outer diameter of tube 60 so that it is frictionally held in any adjusted position but preferably at least partially above coil C where it forms a "top hat" for the antenna.

As the sleeve 80 is moved from a position remote from the coil C toward the coil C, the flux lines in the coil C are first prevented from returning to the coil and the inductance of the coil C is reduced. This increases the resonant frequency of the antenna. As the sleeve 80 is moved further toward the coil C, a point is reached where the flux lines of the coil C instead of being cut off are crowded inside the sleeve 80 and the effect is to increase the inductance of the coil C thus, lowering the resonsant frequency of the antenna system. By appropriately positioning the sleeve 80, the inductance of the coil C may be readily adjusted and the resonant frequency of the antenna varied within a given range.

The width of the slot is important. With no slot, the axial position of the sleeve is very critical. As the slot widens, the effect of the sleeve decreases. A slot width of 9/16 inches is preferred. The length is also critical, the longer the sleeve, the greater range of adjustment of the inductance of the coil C. Six inches is preferred. The same is true with the diameter. As the diameter increases, the effect is less. An inner diameter of approximately 1 ⅛ inches is preferred.

In a like manner, for varying the coupling ratio of the matching coupling transformer D, an electrically conductive sleeve 90 having a longitudinally extending slit 91 is slidably and frictionally supported on the outside of the housing tube 62 and surrounding the transformer D. Movement of the sleeve 90 upwardly and downwardly varies the impedance transforming ratio of the transformer D and enables a matching of the high impedance at the lower end of the radiating portion B to the impedance of the coaxial cable.

The sleeve 90 has approximately the same dimension as sleeve 80.

In effect, the antenna itself is comprised of two linear radiating portions 10, 12 in axially aligned and spaced relationship with a first or loading coil coaxial therewith and with the ends thereof electrically connected to the adjacent ends of the linear portions 10, 12. This coil is thus in electrical series with the linear portions 10, 12 and increases the effective electrical length of the antenna substantially over and beyond that of its overall physical length.

In a like manner, there is a second coil connected to the lower end of the tube 13 which in effect further increases the effective electrical length of the linear portions above and beyond that of the physical electrical length. This second coil of course is also used as a means of coupling a feedline to the antenna. The lower end of the second coil is at a relatively high radio frequency voltage which radio frequency voltage will appear on the shield of the coaxial cable. However, by forming the coaxial cable into a coil around the ferrite core to form a choke or inductance, the radio frequency energy is prevented from appearing at the lower end of this coil.

By using the ferrite core, the inductance of this coaxial cable coil is substantially increased for a given length and for a given diameter.

The electrical portions of the antenna shown in the accompanying drawing from the top of the member 10 to the bottom of the coil E is approximately 80 inches, the exact length not being important inasmuch as the variations in length can be compensated for by increasing or decreasing the number of turns in the loading coil C and positioning the sleeve 80. The housing H, however, has a length which can be extended from the maximum length of the antenna members to approximately ten feet such that it is a simple matter to set the antenna anywhere in a room with its base on the floor and extend the upper tube 60 upwardly so that its upper end engages the ceiling of the room, thus supporting the antenna in its vertical position at any point in the room.

In the embodiment shown a cover 100 is positioned over the upper end of the tube 60 and a cover 102 is positioned over the lower end of the tube 62. These covers have no function other than one of appearance and frictional engagement with the respective surfaces.

To place the antenna described above in operation, it is only necessary to connect a conventional standing wave ratio (SWR) meter in series with the coaxial cable at the transmitter. The SWR meter is then adjusted so as to read maximum forward power. It is then switched to reflected power and the sleeve 80 is adjusted relative to the coil C until the reflected power is at a minimum. Thereafter, it is well to check the forward power. Thereafter, the sleeve 90 is vertically adjusted relative to transformer D and for minimum SWR. Sometimes it is necessary to readjust sleeve 80 and then again sleeve 90. It has been found in experimental work that the standing wave ratio can be reduced to 1.0 to 1 at any one given output frequency of the transmitter, for example, in the middle of the Citizens' Band and that such standing wave ratio does not increase beyond 1.2 to 1 if the frequency of the transmitter is then varied to both limits of the Citizens' Band currently allocated.

Obviously, if it is desired to operate the transmitter on a frequency other than the center frequency of the Citizens' Band and have an absolute minimum standing ratio, it is possible by the adjustment of the position of the sleeves 80 and 90 to achieve such low standing wave ratios at any desired frequency.

Of course, if it is desired to operate the antenna in a band far removed from the Citizens' Band, e.g. in the 10, 15 or 20 amateur band, all that is necessary is to remove the assembly of the two aluminum tubes 10, 12 and the loading coil C and replace same with different length tubes 10, 12 and/or a loading coil C of appropriate number of turns. The antenna described is an electrical half wavelength long ($\lambda/2$). The angle of radiation is very low. By varying its effective electrical length, various angles of radiation may be obtained. By adjusting the sleeve 90, the various end impedances of the various wavelength antennas may be readily matched to the feed-line.

One of the principal values of the present antenna is that it can be installed within a room occupying an absolute minimum of floor space, can be easily and readily tuned to an exact desired resonant frequency, adjusted to give a minimum reflected power on the transmission line and which will have a maximum radiating efficiency for a shortened antenna.

The antenna described has an effective electrical length greater than its physical length. By effective electrical length is meant the frequency at which the linear members and associated coils are resonant it being appreciated that a straight linear conductor in free space has an approximate resonant frequency defined by the formula:

$$f\,(in\ mH) = 468/L\ (in\ feet)$$

By using coils which have inductance intermediate the ends of the linear conductor and/or at one end, as in the present embodiment, the resonant frequency for the same physical length can be substantially lowered. The number of turns in such coils for a desired resonant frequency may be calculated but are normally determined by "cut and try".

It is believed that the use of an extendable insulated housing is novel. It is also believed that the arrangement for tuning the loading coil is novel. Further, it is believed that the method of matching the high impedance end of the antenna to a feed length and isolating the end from the feedline is novel.

The invention has been described in reference to a preferred embodiment. Obviously, modifications and alterations will occur to others upon a reading and understanding of the present specification and it is my intention to include all such modifications and alterations insofar as they come in the scope of the appended claims.

Having thus described the invention, I claim:

1. A radio transmitting antenna comprised of:
   an elongated conductive member having its ends in generally fixed spaced relationship and having an effective electrical length generally equal to $\lambda/2$ at the desired frequency of operation;
   means at one end of said conductive member for coupling said end of said conductive member to at least a transmitter tuned to said frequency;
   and elongated generally rigid electrical insulating means extending beyond at least one end of said conductive member, the amount of extension being adjustable whereby said antenna may be elongated independently of the length of the conductive member and may be supported in any position by having the ends of said antenna engage opposed surfaces of a building.

2. The antenna of claim 1 wherein the means connecting said conductive member to said transmitter is at one end of said conductive member.

3. The antenna of claim 1 wherein said conductive member includes a pair of linear aligned portions and a multi-turn coil between the adjacent ends of said linear portions and with its terminals connected to the respective adjacent ends of said linear portions whereby the effective electrical length of said conductive member for a given overall physical length is greater than the physical length;
   the insulating means is a tube coaxial with and spaced from said coil; and, an electrically conductive member is adjustably supported on said tube adjacent to said coil.

4. The antenna of claim 3 wherein said electrically conductive member is in the form of a longitudinally split sleeve.

5. The antenna of claim 3 wherein said electrically conductive member is on the outside of and frictionally engages said tube.

6. The antenna of claim 1 wherein said insulating member is in the form of a pair of telescoping tubes coaxial with the length of said conductive member.

7. The antenna of claim 6 wherein one of said tubes is axially slidable in frictional engagement within the other of said tubes.

8. The antenna of claim 7 wherein means are provided for locking said tubes in any adjusted position.

9. The antenna of claim 8 wherein the end of the outermost of said tubes in which the inner tube is slidable, has longitudinal slits therein and a ring surrounds said slit end for pressing the portions between the slit into locking and frictional engagement with said inner tube.

10. A radio transmitting antenna comprised of;
   an elongated electrically conductive member including a rigid linear portion and a multiturn coil portion immediately adjacent one end of said linear portion and having one of its terminals connected to said one end of said linear portion;
   the two portions coacting so as to have an effective electrical length of $\lambda/2$ so as to be generally resonant at the desired frequency of operation; and
   a multi-turn coil of coaxial cable having one end electrically coupled to said coil portion and the other end adapted to be connected to a transmitter and/or receiver.

11. The antenna of claim 10 including an electrically conductive longitudinally split sleeve coaxial with said coaxial cable coil and axially adjustable relative thereto and a ferrite core inside of said coaxial cable coil.

12. The antenna of claim 10 wherein the shield of the coaxial cable of one terminal of said coaxial cable coil is connected to a second terminal of said coil portion;
   a coupling coil coaxial with said coil portion having one terminal connected to said second terminal and the other terminal connected to the center conductor of the respective end of said coaxial cable.

13. The antenna of claim 10 wherein the shield of one terminal of the coaxial cable coil is connected to a second terminal of said coil portion, and the coaxial cable center conductor of the respective end of said coaxial cable coil is connected to a tap on said coil portion.

14. The antenna of claim 10 wherein the linear portion of said electrically conductive member is divided into a pair of aligned secondary portions;
   a multi-turn coil coaxial with said secondary portions having its terminals connected to the respective adjacent ends of said secondary linear portions.

15. The antenna of claim 14 including a longitudinally split sleeve axially slidable in coaxial relationship with said last mentioned multi-turn coil.

16. The antenna of claim 10 including an electrically conductive longitudinally split sleeve coaxial with said coaxial cable coil and axially adjustable relative thereto.

17. The antenna of claim 16 including a ferrite core inside of said coaxial cable coil.

18. The antenna of claim 16 including a tube of electrically insulating material coaxial with said coaxial cable coil and in spaced relationship thereto said longitudinally split sleeve being axially slidable on said tube.

19. The antenna of claim 17 wherein the shield of one terminal of the coaxial cable coil is connected to a second terminal of said coil portion; a coupling coil is coaxial with said coil portion and has one terminal connected to said second terminal and the other terminal connected to the center conductor of the coaxial cable of the respective end thereof.

20. The antenna of claim 18 wherein the shield of one terminal of the coaxial cable coil is connected to a second terminal of said coil portion; a coupling coil is coaxial with said coil portion and has one terminal connected to said second terminal and the other terminal connected to the center conductor of the coaxial cable of the respective end thereof.

21. The antenna of claim 18 wherein said sleeve is on the outside of and frictionally engages said tube.

22. A vertical radio antenna comprised of an elongated electrically conductive member having an effective electrical length generally equal to $\lambda/2$ including first and second linear portions in axially aligned relationship; a first multi-turn coil axial with said linear members and having its terminals connected respectively to the adjacent ends of said linear portions; a second multi-turn coil coaxial with and adjacent to the end of one of said linear members remote from said first coil and having a terminal connected to said remote end; a third coil coaxial with said second coil and having one terminal connected to the other terminal of said second coil; a coil of coaxial cable in axial alignment with said linear portions and said first and second coils; the shield of the adjacent end of said coaxial cable being connected to the other terminal of said third coil and the center conductor of said end of said coaxial cable being connected to the other terminal of said third cable; the other end of said coaxial cable being adapted to be connected to a radio transmitter and/or receiver.

23. The antenna of claim 22 including a first longitudinally split electrically conductive sleeve coaxial with and axially adjustable relative to said first coil and a second longitudinally split electrically conductive sleeve coaxial with and axially adjustable relative to said second coil.

24. The antenna of claim 23 including a pair of axially slidable and adjustable tubes of electrically insulating material coaxial with and of a total extended length greater than the combined physical length of said linear portions and fourth coil whereby said antenna may be held in a desired physical position by axially elongating the two plastic tubes so as to engage opposing surfaces.

25. A radio transmitting antenna comprised of: an elongated electrically conductive member including a linear portion and a multi-turn coil portion electrically associated with said linear portion to increase the effective electrical length thereof, the linear portion being generally on the axis of said coil portion, the two portions having an effective electrical length $\lambda/2$ so as to be resonant at the approximate desired frequency of operation; an electrically conductive sleeve coaxial with and having an inner diameter greater than the outer diameter of said multi-turn coil portion; and means supporting said sleeve for adjustment axially relative to said coil portion whereby the resonant frequency of said antenna can be easily adjusted.

26. The antenna of claim 25 wherein said sleeve is longitudinally split throughout its entire length and the edges of said split are in spaced relationship.

27. The improvement of claim 25 wherein said means for supporting said sleeve comprise a tubular member of electrically insulating material generally coaxial with said coil and linear portions and having an inner diameter greater than said coil portion.

28. The antenna of claim 1 wherein said conductive member is, at least in part, comprised of electrically conductive wire supported by insulating means.

29. The antenna of claim 28 wherein said wire is in the form of a helix.

30. The antenna of claim 1 wherein said conductive member is generally rigid and at least in part, is comprised of an electrically conductive wire supported by generally rigid insulating means.

* * * * *